US011851983B2

(12) United States Patent
Ross et al.

(10) Patent No.: US 11,851,983 B2
(45) Date of Patent: Dec. 26, 2023

(54) RUPTURE APPARATUS

(71) Applicant: METROL TECHNOLOGY LIMITED, Aberdeen (GB)

(72) Inventors: Shaun Compton Ross, Aberdeen (GB); Leslie David Jarvis, Stonehaven (GB); David Glen Martin, Banffshire (GB)

(73) Assignee: METROL TECHNOLOGY LIMITED, Aberdeen (GB)

( * ) Notice: Subject to any disclaimer, the term of this patent is extended or adjusted under 35 U.S.C. 154(b) by 90 days.

(21) Appl. No.: 17/593,384

(22) PCT Filed: Mar. 16, 2020

(86) PCT No.: PCT/GB2020/050671
§ 371 (c)(1),
(2) Date: Sep. 17, 2021

(87) PCT Pub. No.: WO2020/188265
PCT Pub. Date: Sep. 24, 2020

(65) Prior Publication Data

US 2022/0154552 A1 May 19, 2022

(30) Foreign Application Priority Data

Mar. 20, 2019 (GB) ..... 1903843

(51) Int. Cl.
*E21B 34/14* (2006.01)
*E21B 17/18* (2006.01)
(Continued)

(52) U.S. Cl.
CPC ..... *E21B 34/063* (2013.01); *E21B 17/18* (2013.01); *E21B 21/103* (2013.01); *E21B 33/14* (2013.01); *E21B 34/14* (2013.01); *E21B 43/12* (2013.01)

(58) Field of Classification Search
CPC ..... E21B 34/063; E21B 21/103; E21B 34/14; E21B 34/142; E21B 17/18
See application file for complete search history.

(56) References Cited

U.S. PATENT DOCUMENTS 4,039,031 A 8/1977 Crowe
4,059,157 A * 11/1977 Crowe ..... E21B 34/063 137/68.22

(Continued)

FOREIGN PATENT DOCUMENTS

EP 3020912 5/2016

OTHER PUBLICATIONS

UKIPO Combined Search and Examination Report for Application No. GB1903843.9, dated Aug. 14, 2019.

(Continued)

*Primary Examiner* — Catherine Loikith
(74) *Attorney, Agent, or Firm* — WOMBLE BOND DICKINSON (US) LLP

(57) ABSTRACT

A rupture apparatus (50) often deployed within a wall of a casing string (53) of an oil and gas well, comprising a housing (51) defining a housing bore (54) with a bore inlet and a bore outlet; a carriage carrying a rupturable component (12) the carriage being moveable in the housing bore between a rupturable position, an open and a closed position. Thus the bore can be opened or closed or closed subject to rupture of the rupturable component (12). Moreover, after rupture the bore can still be closed. Wireless signals are normally used to for control, especially electromagnetic or acoustic signals. A pressure balancing port (6) may be defined in a wall of the housing allowing fluid communication between at least a portion of the housing bore, and an outside of the housing which can pressure-balance the carriage such that it remains stationary unless actuated.

31 Claims, 9 Drawing Sheets

Figure 1A:
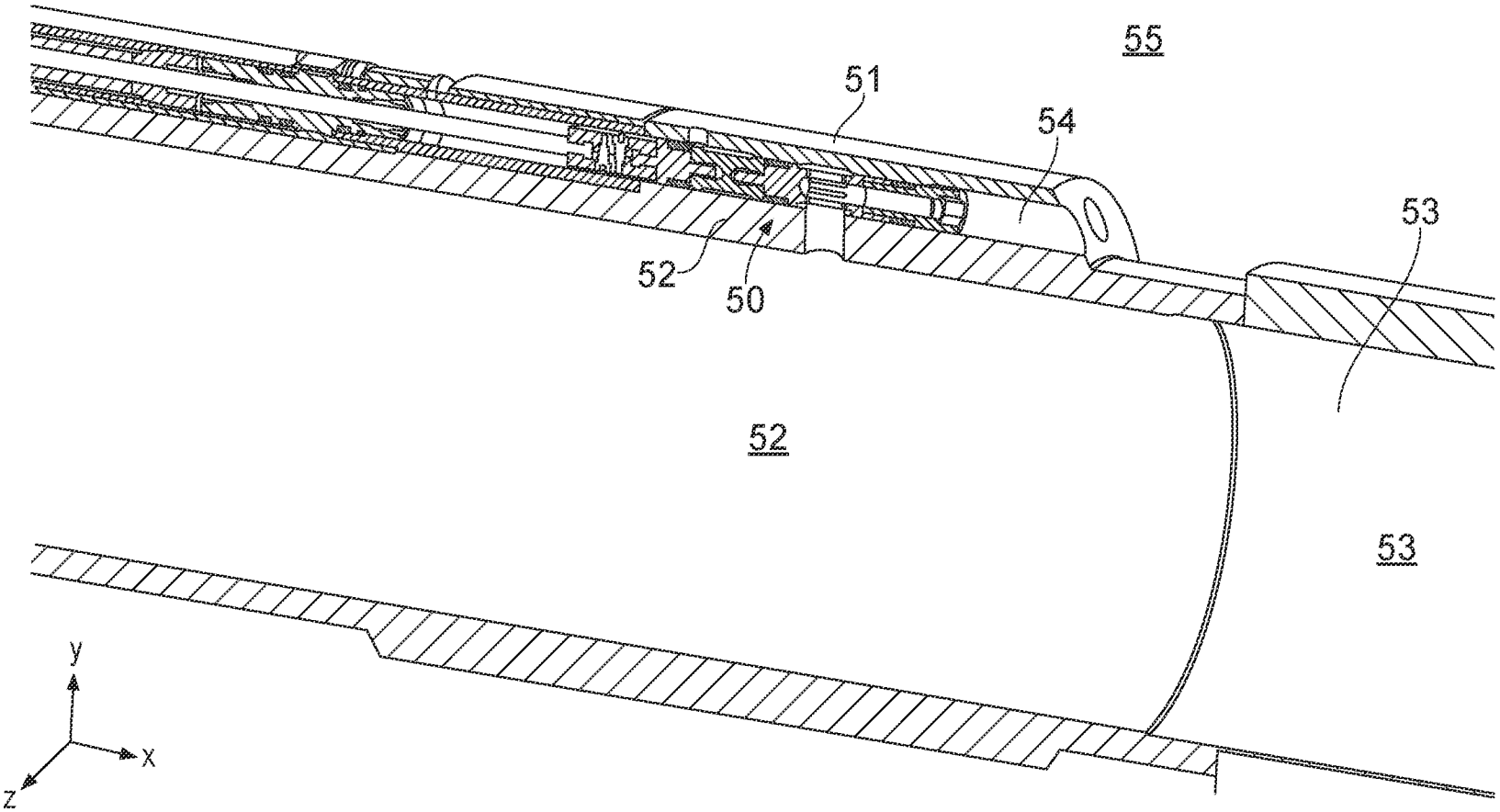

(51) Int. Cl.

| | |
|---|---|
| ***E21B 34/06*** | (2006.01) |
| ***E21B 21/10*** | (2006.01) |
| ***E21B 33/14*** | (2006.01) |
| ***E21B 43/12*** | (2006.01) |

(56) References Cited

U.S. PATENT DOCUMENTS

| | | | | |
|---|---|---|---|---|
| 4,427,070 | A | 1/1984 | O'Brien | |
| 4,429,747 | A | 2/1984 | Williamson | |
| 4,907,655 | A | 3/1990 | Hromas | |
| 6,145,595 | A | 11/2000 | Burris | |
| 6,550,541 | B2 | 4/2003 | Patel | |
| 2001/0042626 | A1 | 11/2001 | Patel | |
| 2004/0020657 | A1 | 2/2004 | Patel | |
| 2005/0189107 | A1 | 9/2005 | McVay et al. | |
| 2009/0288838 | A1 | 11/2009 | Richards | |
| 2010/0314562 | A1 | 12/2010 | Bisset | |
| 2013/0025872 | A1 | 1/2013 | Mailand et al. | |
| 2014/0251619 | A1 | 9/2014 | George et al. | |
| 2014/0284060 | A1 | 9/2014 | Ward et al. | |
| 2017/0198549 | A1* | 7/2017 | Freeman | E21B 34/063 |
| 2018/0142533 | A1* | 5/2018 | Joerpeland | E21B 41/02 |

OTHER PUBLICATIONS

EPO Examination Report for Corresponding European application 20715138.2, dated Aug. 29, 2022.
International Search Report and Written Opinion for PCT/GB2020/050671, dated Sep. 24, 2020.

* cited by examiner

Detail 'B' (1:3)

RUPTURE APPARATUS

CROSS REFERENCE TO RELATED APPLICATIONS

This application is a 35 U.S.C. 371 National Stage of International Application No. PCT/GB2020/050671, titled "RUPTURE APPARATUS", filed Mar. 16, 2020, which claims priority to GB Application No. 1903843.9, titled "RUPTURE APPARATUS", filed Mar. 20, 2019, all of which are incorporated by reference herein in their entirety.

The present invention relates to a rupture apparatus often with a tubular member, especially a casing, for use in a well, especially an oil and gas well.

The pressure in wells varies depending on a number of different factors, such as the natural pressure in the well, and various controls imposed on the well. Tubes or tubulars used in a well need to withstand the pressures that are expected to occur in use.

However, on occasion a pressure in the well, especially an annulus, exceeds the expected pressure which can cause the tubulars to break. This can potentially cause an uncontrolled escape of hydrocarbons, damaging the environment. To reduce this risk in higher temperature wells, production can be slowed, thus reducing pressure build-up in the annulus caused by heat from the produced fluids.

To address this danger, it is also known to provide a rupturable component such as a rupture disc in tubulars in a well. Under expected operating conditions, the tubular operates normally, and the rupture disc maintains the integrity of the tubulars. However, if the pressure exceeds a certain threshold value, the rupture disc will burst or rupture, and allow pressure in the annulus to vent in the tubular to escape in a relatively controlled fashion.

In certain applications a rupture disc may be used to deliberately burst or rupture in order to allow for fluid release.

Whilst generally satisfactory, the inventors of the present invention have noted that at least one improvement may be made in the use of rupturable components.

In accordance with a first aspect of the present invention there is provided a rupture apparatus comprising:

- a housing defining a housing bore with a bore inlet and a bore outlet,
- a carriage carrying a rupturable component;
- wherein the carriage is moveable in the housing bore between a rupturable position and at least one of an open and closed position.

The rupture apparatus may be disposed on a tubular member.

In accordance with a second aspect of the present invention, there is provided a tubular member apparatus comprising the rupture apparatus as described herein, and a tubular member, wherein the tubular member defines an inner bore.

The housing bore is normally in fluid communication with at least a portion of an outside of the tubular member and the inner bore of the tubular member.

In use the bore inlet is aligned with a port in the tubular member. Thus, the rupture apparatus provides a valve between an inside of a tubular member and the surrounding area, the valve positions normally including an open, closed and rupturable position.

The housing bore is normally off-centre, relative to the tubular. Accordingly, the main axis of the housing bore is normally off-centre compared to the main axis of the tubular, albeit normally parallel thereto. In this way, the bore of the tubular is typically free for fluid flow or other access.

The rupture apparatus may be integrated, that is within the wall of the tubular, such as sharing a wall, which in part defines the housing bore on one side of the wall, and in part, defines the tubular on an opposite side of the wall.

Alternatively, the rupture apparatus may be separate and fixed, or retro-fitted, to a tubular, such as on a side pocket mandrel.

The rupture apparatus may comprise a pressure balancing port. The pressure balancing port is preferably defined in the wall of the housing, such that it allows fluid communication between at least a portion of the housing bore and the surrounding area, or between the housing bore and the bore of the tubular.

Thus, at least a portion of a first face of the rupturable component may be exposed to a first pressure, and at least a portion of an opposing face of the rupturable component exposed to a second pressure, one of said faces being exposed to said first or second pressure via the pressure balancing port.

Thus, in the open position, at least a portion of a first face of the rupturable component may be exposed to the same or similar pressure as an opposing face of the rupturable component, one of said faces being exposed to pressure via the pressure balancing port and so at least offsetting forces acting on the other side of the rupturable component.

The carriage typically comprises a longitudinal member, and typically a holder for carrying the rupturable component.

At least one seal is normally provided between the carriage and the housing bore, normally at least two seals or three seals or more. The carriage normally carries the seal or seals. The seals may be therefore on an outer surface of the carriage for sealing with the inner surface of the housing bore. The at least one seal may be a non-elastomeric seal, and may be a metallic seal and/or a metal-to-metal type seal. In alternative embodiments the carriage may carry one or more seal seats and the seats engage with seals provided in the inner surface of the housing bore.

If the valve apparatus comprises more than one seal, then the area exposed to pressure on each respective outer or inner side of the seals in use may be at least partially, ideally fully balanced. More generally, the pressures acting across the carriage are typically partially balanced and therefore, the resulting forces acting across the carriage will be reduced. Accordingly, if fully balanced, for such embodiments, the carriage will not move in the absence of other forces (such as from an actuator).

Preferably therefore, an opposite side of a seal is exposed to pressure through a pressure balancing port.

In at least the closed and/or rupturable position(s), two seals are preferably configured to actively seal with an inner face of the housing bore simultaneously. Optionally, a third seal may be inactive when the said two seals are active, which typically reduces frictional forces. The at least two active seals are typically located on either side of the port when the carriage is in this/these position(s). Whether or not each of the at least one seal(s) is active typically depends on the carriage position and different seals may be active in different carriage positions. The forces across the carriage are usually offset with the pressure balance port and are preferably balanced. This is typically because the area exposed to the same tubular pressure of the associated tubular on one side of the carriage (typically innermost side), and a similar or the same surrounding pressure on the other side (typically outermost side). Therefore, the carriage requires less applied force to move.

In certain carriage positions, at least one seal can deactivate. In different positions zero or only one or only two sets of seals may be active at one time. Optionally, at least one seal may be active in the open valve position.

The housing bore may have multiple diameters. At least one section of the housing bore may have a relatively larger diameter than at least another section of the housing bore. Therefore, when a seal is aligned with such a relatively larger diameter of the housing bore, the seal will deactivate.

The carriage may be moveable in the housing bore between the rupturable position and the open position. The carriage may be moveable in the housing bore between the rupturable position and the closed position. The carriage may be moveable in the housing bore between at least three positions. These at least three positions are preferably the rupturable position, the closed position and the open position.

The longitudinal member of the carriage may be a tube and may include a carriage port allowing communication between a housing bore of the tube and an outside of the tube.

A path for fluid flow through the housing is typically defined in the housing bore. This may be the primary path for fluid flow, that is, the path with the greatest capacity for fluid to flow.

The fluid flow path is configured such that fluid can flow along the flow path in from the housing bore inlet, through the housing bore and out of the housing bore outlet. The extent to which fluid may flow along the primary flow path may be controllable, in use, depending on the valve position.

The seal(s) is/are preferably outside the primary path of fluid flow through the housing bore in one or more or all valve position(s).

The rupturable component typically has at least two faces, preferably opposing faces, and is preferably capable of fluid communication with at least a portion of the housing bore on those faces, which may be facilitated by the longitudinal member of the carriage being at least partially hollow.

The rupturable component may be of any shape such as a rupture disc, a rupture membrane or a piston held in place by a shear pin. The rupturable component is preferably rupturable in at least one direction in response to a differential pressure thereacross which meets and/or exceeds a predetermined threshold value. The rupture state of the rupturable component may refer to whether the rupturable component has ruptured or not.

The rupturable component is typically configured to rupture at a particular differential pressure threshold. This differential pressure threshold is usually in the range of 1-20,000 psi, normally 500-20,000 psi and optionally 1000-15,000 psi.

The housing may be formed on the tubular member such that the rupture apparatus may be disposed on a wall of the tubular member, and preferably the outer wall. The housing bore in the rupture apparatus referred to hereinabove may be a seal bore.

The pressure balancing port is preferably in fluid communication with at least a portion of the outside of the tubular member and an outside of the rupture apparatus; which may also be the wellbore annulus.

The tubular member may be a casing used in wells, and the surrounding area in use may be an annulus of a well between the tubular and the geological formation/another tubular.

All references to casing herein include liners unless stated otherwise.

The casing preferably comprises an inner diameter of at least 5 inches (127 mm), but it may have an inner diameter of between 5 inches (127 mm) and 20 inches (510 mm), or more preferably up to 13 inches (330 mm).

In the closed valve position, the rupture apparatus resists fluid communication between the inner bore of the tubular member and the outside of the tubular member. In this position, the rupturable component is also preferably sealed by the at least one seal from being in fluid communication with the port and inner bore of the tubular member. The rupture apparatus may be configured such that if it is in the closed position, at least one seal is unseated in the section of the housing bore with the relatively larger diameter. The seal being unseated when not in use which may preserve the integrity of the seal, and/or reduce friction on the sealing surface(s). A first face of the rupture component may be in fluid communication with the outside of the tubular member optionally via the inner bore, and a second face of the rupturable component may be in fluid communication with the outside of tubular member optionally via the at least one seal carriage port. Alternatively, a further pressure balance port may be provided and all seals can remain engaged. In any case, at least a portion of the two faces of the rupturable component are preferably in fluid communication with the outside of tubular member (or alternatively the inside of the tubular member), such that the pressures acting on either face of the rupturable component offset each other and are preferably balanced, and the rupturable component will not rupture in the closed valve position.

In the open valve position, at least a portion of the second face of the rupturable component is in fluid communication with the outside of the tubular member optionally via the pressure balancing port. At least a portion of the first face of the rupturable component is in fluid communication with the outside of the tubular member optionally via the inner bore. Preferably, both faces of the rupturable component are in fluid communication with the outside of the tubular, such that the pressures acting on either face of the rupturable component offset each other and are preferably balanced and the rupturable component will not rupture in the open valve position.

In the rupturable valve position, at least a portion of the second face of the rupturable component is in fluid communication with the inner bore of the tubular member optionally via the port, and at least a portion of the first face of the rupturable component is in fluid communication with the outside of the tubular member optionally via the housing bore. This valve position preferably facilitates a differential pressure to act across the rupturable component.

The carriage may be positionable (and repositionable) independently of the rupture state of the rupturable component, such that the valve may be moveable between the open, closed and rupturable positions repeatedly. The carriage is preferably moveable into any position without changing the rupture state of the rupturable component.

Preferably, if the rupture apparatus is in the rupturable position and the rupturable component has not ruptured and/or is intact, the path for fluid flow through the housing bore will be conditionally obstructed. Preferably, if the differential pressure acting across the rupturable component exceeds a threshold value, the rupturable component is configured to rupture and thereby facilitate the path for fluid flow through the housing bore. If it is desired to obstruct the path for fluid flow if the rupturable component has ruptured, the rupture apparatus is normally moveable into the closed position.

Sensors may be provided as part of the rupture apparatus or in a well and connected (physically or wirelessly) in use. In particular pressure sensors, and optionally temperature sensors, are particularly useful.

The rupture apparatus may comprise, or be coupled (physically or wirelessly), to a wireless communication module configured to receive wireless signals to direct movement of the carriage.

The communication module is typically capable of sending signals back. This may relate to confirmation signals, carriage position or data, such as pressure data, detected at or around the rupture apparatus.

Wireless signals may be in at least one of the following forms: electromagnetic, acoustic, coded pressure pulses and inductively coupled tubulars. Acoustic and/or electromagnetic are particularly preferred.

The rupture or tubular apparatus may be wirelessly controllable by a control signal more than 24 hours after being run into the well, optionally more than 7 days, more than 1 month, more than 1 year or more than 5 years. This is normally when the casing is installed and cemented in place.

Pressure pulses include methods of communicating from/to within the well/borehole, from/to at least one of a further location within the well/borehole, and the surface of the well/borehole, using positive and/or negative pressure changes, and/or flow rate changes of a fluid in a tubular and/or annular space.

Coded pressure pulses are such pressure pulses where a modulation scheme has been used to encode commands within the pressure or flow rate variations and a transducer is used within the well/borehole to detect and/or generate the variations, and/or an electronic system is used within the well/borehole to encode and/or decode commands. Therefore, pressure pulses used with an in-well/borehole electronic interface are herein defined as coded pressure pulses. An advantage of coded pressure pulses, as defined herein, is that they can be sent to electronic interfaces and may provide greater data rate and/or bandwidth than pressure pulses sent to mechanical interfaces.

Coded pressure pulses can be induced in static or flowing fluids and may be detected by directly or indirectly measuring changes in pressure and/or flow rate. Fluids include liquids, gasses and multiphase fluids, and may be static control fluids, and/or fluids being produced from or injected into the well.

Acoustic signals and communication may include transmission through vibration of the structure of the well including tubulars, casing, liner, drill pipe, drill collars, tubing, coil tubing, sucker rod, downhole tools; transmission via fluid (including through gas), including transmission through fluids in uncased sections of the well, within tubulars, and within annular spaces; transmission through static or flowing fluids; mechanical transmission through wireline, slickline or coiled rod; transmission through the earth; transmission through wellhead equipment. Communication through the structure and/or through the fluid are preferred.

Acoustic transmission may be at sub-sonic (<20 Hz), sonic (20 Hz-20 kHz), and ultrasonic frequencies (20 kHz-2 MHz). Preferably the acoustic transmission is sonic (20 Hz-20 khz).

Electromagnetic (EM) (sometimes referred to as Quasi-Static (QS)) wireless communication is normally in the frequency bands of: (selected based on propagation characteristics)

sub-ELF (extremely low frequency) <3 Hz (normally above 0.01 Hz);

ELF 3 Hz to 30 Hz;

SLF (super low frequency) 30 Hz to 300 Hz;

ULF (ultra-low frequency) 300 Hz to 3 kHz; and,

VLF (very low frequency) 3 kHz to 30 kHz.

These forms of wireless signals are described in detail in WO2017/203285 the disclosure of this publication being incorporated herein in its entirety by reference.

The carriage is normally configured to move in the housing bore in an axial direction, parallel with or along a main longitudinal axis of the housing bore. This can be parallel to the main axis of an associated tubular, albeit preferably off-centre with respect to the tubular.

The rupture or tubular apparatus may be part of a system comprising an actuator. The actuator may be actuable to, that is configured to, cause movement of the carriage in the housing bore. The actuator is typically an axial-movement actuator and/or may be configured to be wirelessly controllable to result in movement of the carriage. The actuator may comprise a motor and a lead screw. It may be hydraulically powered, for example, or powered by an in-well power source, such as a battery.

For certain embodiments, battery elements and/or other electronics may also be provided in a side pocket and replaceable. This may be same mandrel with two side pockets, one for battery and/or electronics and one for the rupture apparatus; or may be separate side mandrels.

The rupture or tubular apparatus is normally suitable for downhole applications. Therefore, the tubular may be used or provided in a borehole, such as an oil and gas borehole or well. However, the rupture apparatus may be provided on other tubulars, such as pipelines or those used in a processing plant. Embodiments with all of an open, closed and rupturable position are especially suitable for uses outside a borehole, such as pipelines or a processing plant.

Certain embodiments may be used to provide a moveable plug in a bore. Other embodiments may include a packer with packer element, where the rupture apparatus controls the packer element.

For various embodiments of the invention, the open and closed positions can be discrete or proportional, and so may be partially opened and/or partially closed.

According to a further aspect of the present invention, there is provided a well comprising the rupture apparatus according to the first aspect of the invention or the tubular apparatus of the second aspect of the invention, and optionally independently including the optional features described herein.

The well may be a subsea well.

Whilst the rupture apparatus may be provided on any casing string, it can be particularly useful between an A- and B-annulus (thus providing control to the B-annulus) or other casing strings outside thereof.

The rupture apparatus is normally provided relatively deep in the well, such as at least 500 m, 1000 m or at least 1500 m deep in the well. This is measured from the surface of the well, which is defined herein as the top of the uppermost casing.

For certain embodiments, a rupture apparatus as described herein may be provided on each casing string in a well with multiple casing strings and/or more than one on a single casing string.

The actuator is usually a single actuator which provides for movement of the carriage between the rupturable position, the open position and the closed position. Therefore the same actuator can control a separate valve that is associated with a rupture mechanism.

The invention also provides a system comprising a rupture apparatus, an actuator and a tubular having an inner bore, the rupture apparatus comprising:

a housing defining a housing bore with a bore inlet and a bore outlet;

a carriage carrying a rupturable component;

wherein the carriage is moveable in the housing bore between a rupturable position, an open position and a closed position;

wherein the housing bore is in fluid communication with at least a portion of an outside of the tubular member and the inner bore of the tubular member;

and wherein the actuator provides for movement of the carriage between the rupturable position, the open position and the closed position.

Figure 1B:
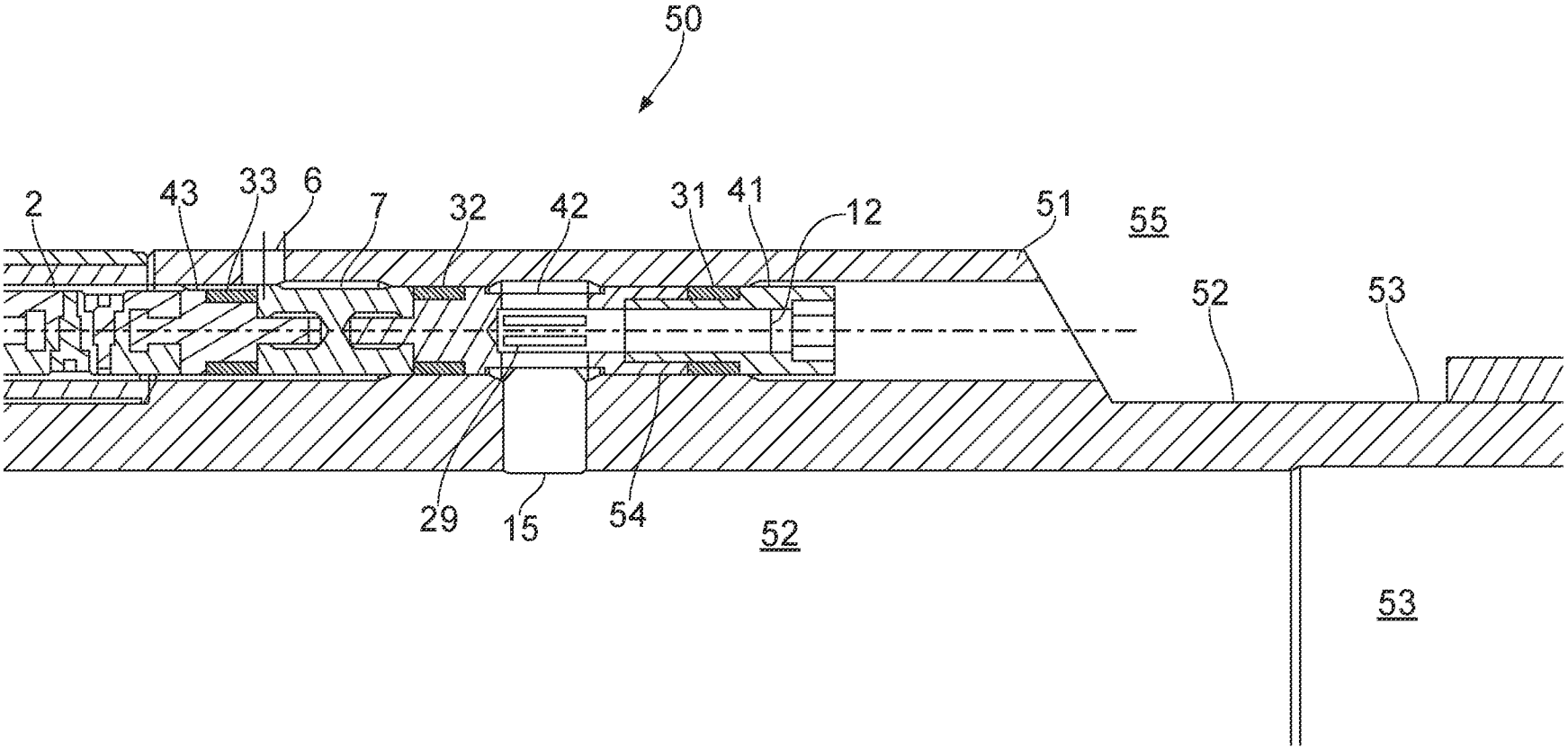

Embodiments of the invention will now be described by way of example only and with reference to the accompanying drawings, in which:

FIG. 1*a* is a sectional perspective view of a casing string with a rupture apparatus with moveable seal carriers shown in a rupturable position;

FIG. 1*b* is a cross-sectional view of the rupture apparatus of FIG. 1*a;*

Figure 1C:
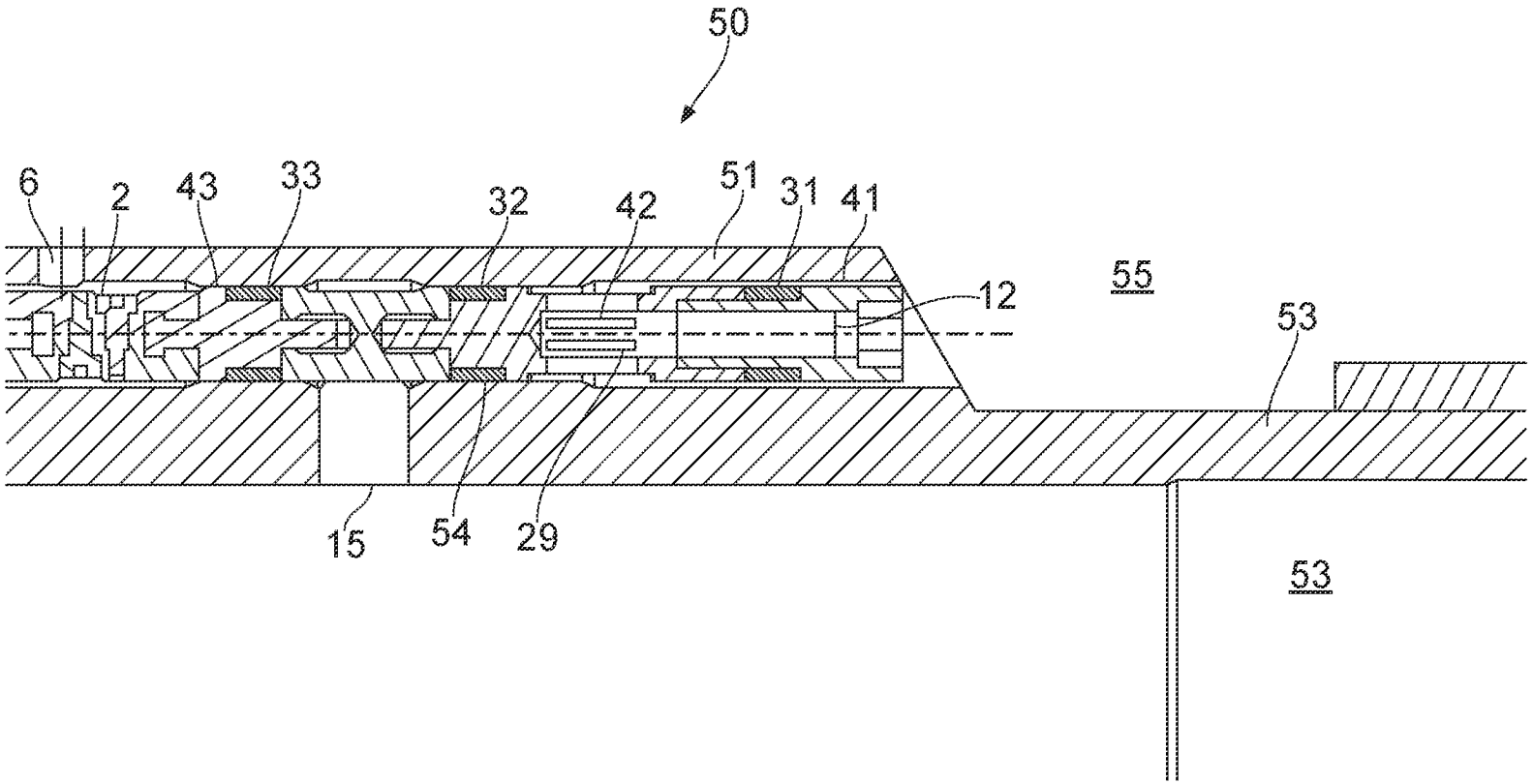
Figure 1D:
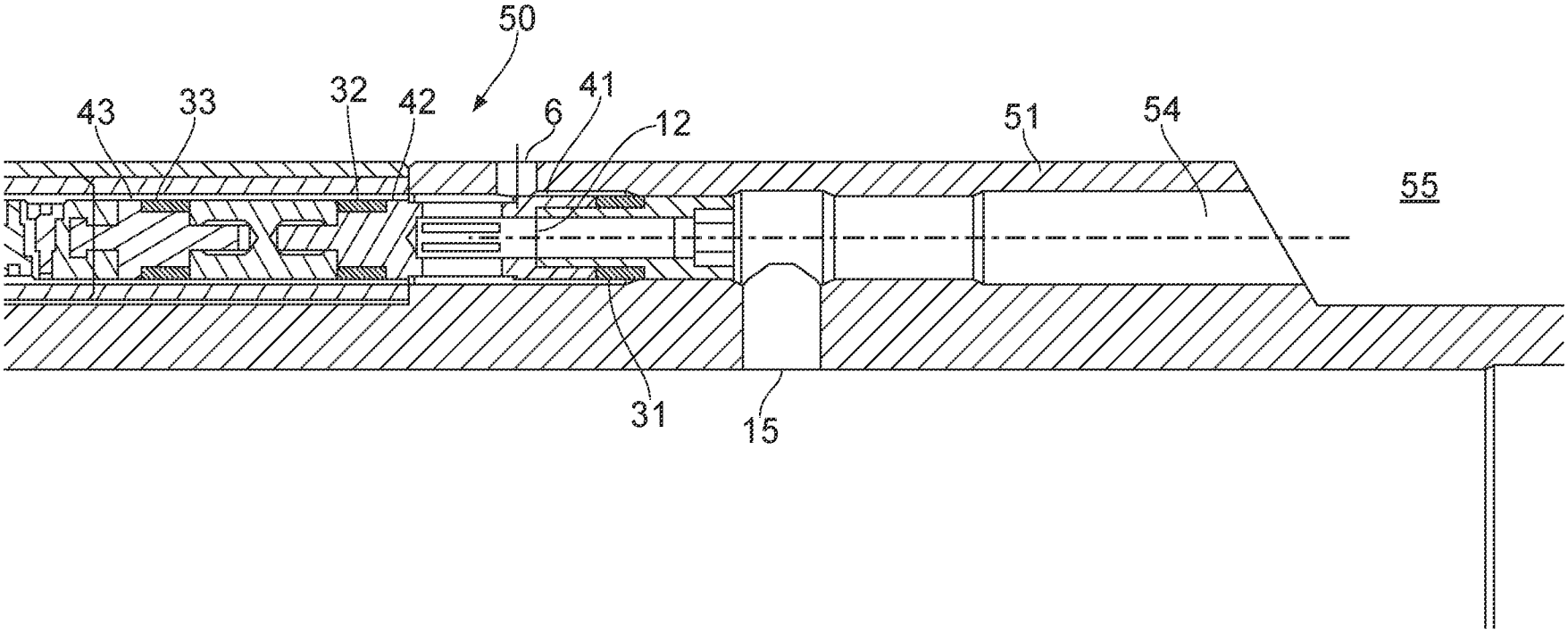
Figure 2A:
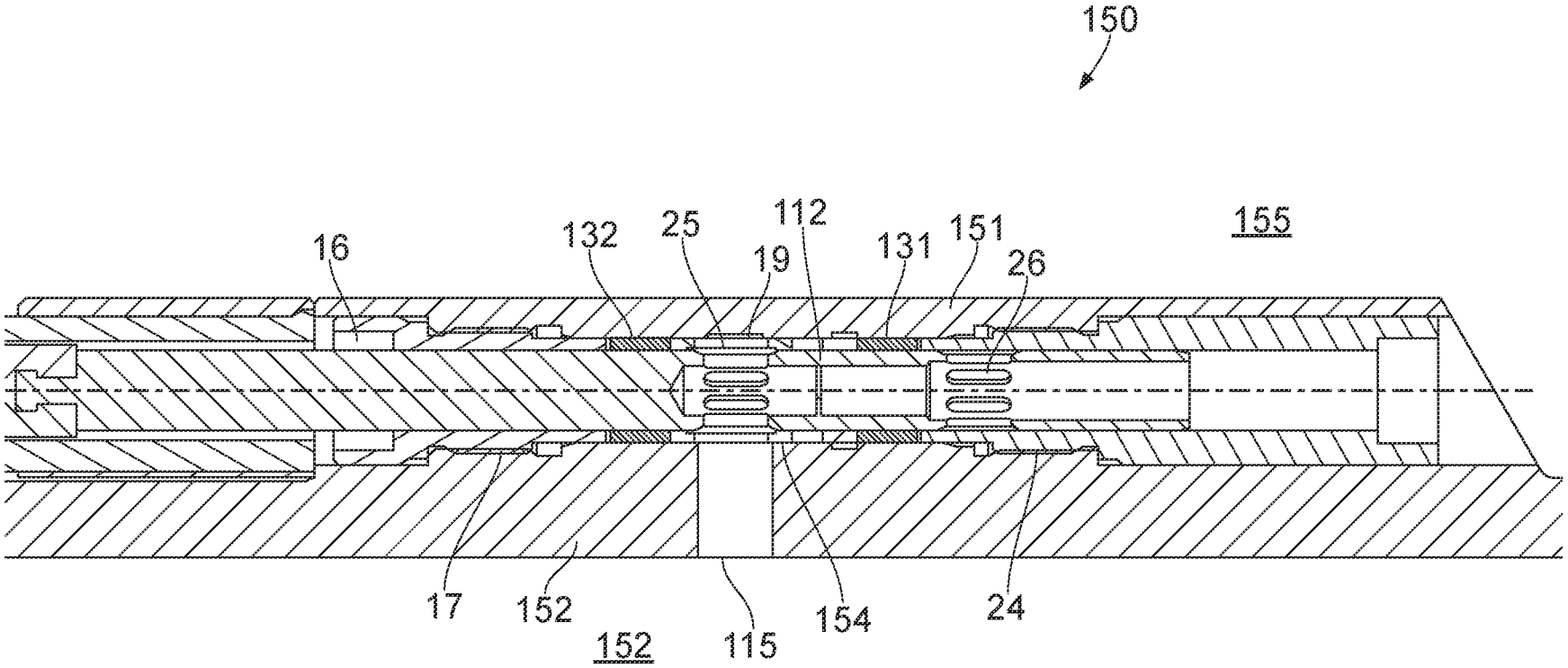
Figure 2B:
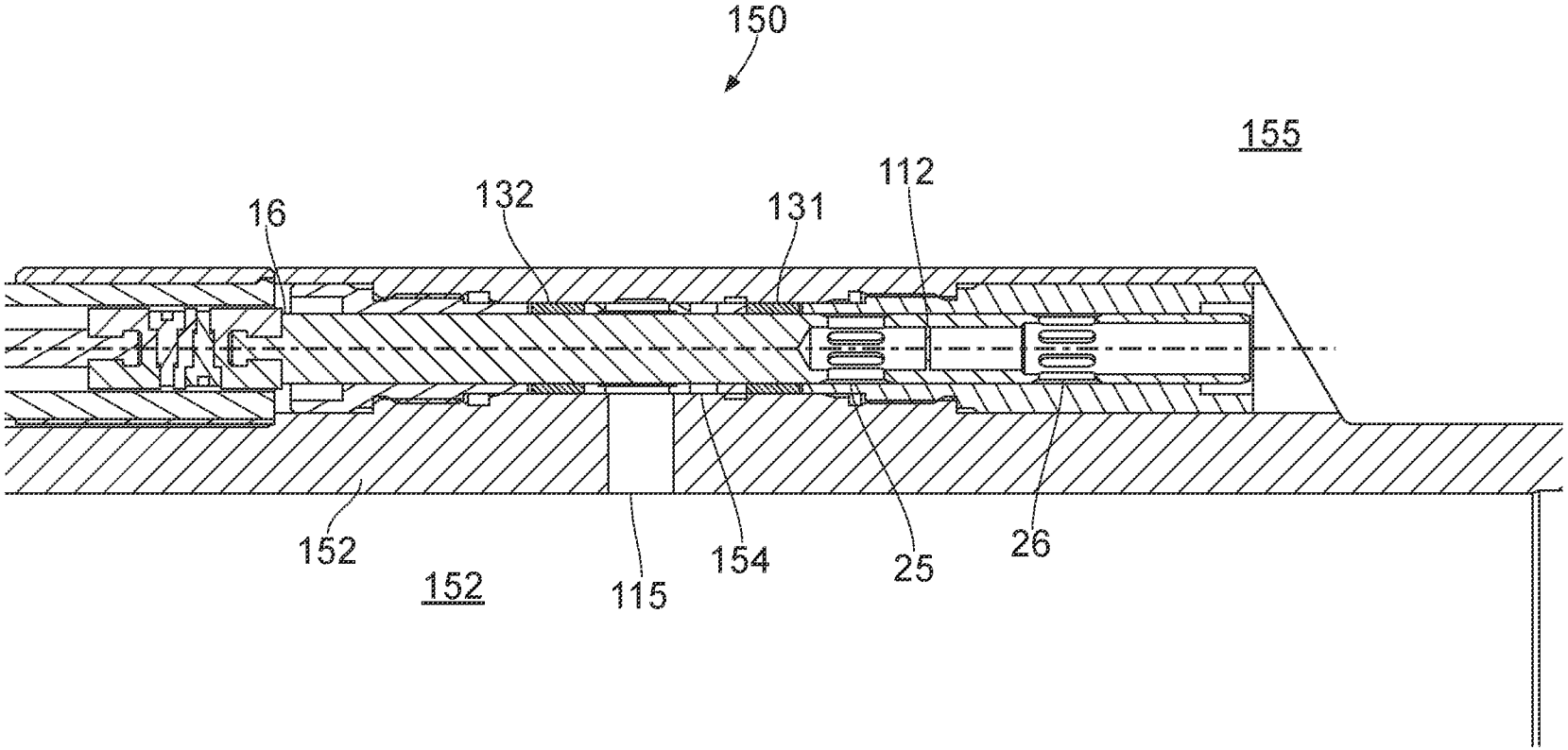
Figure 2C:
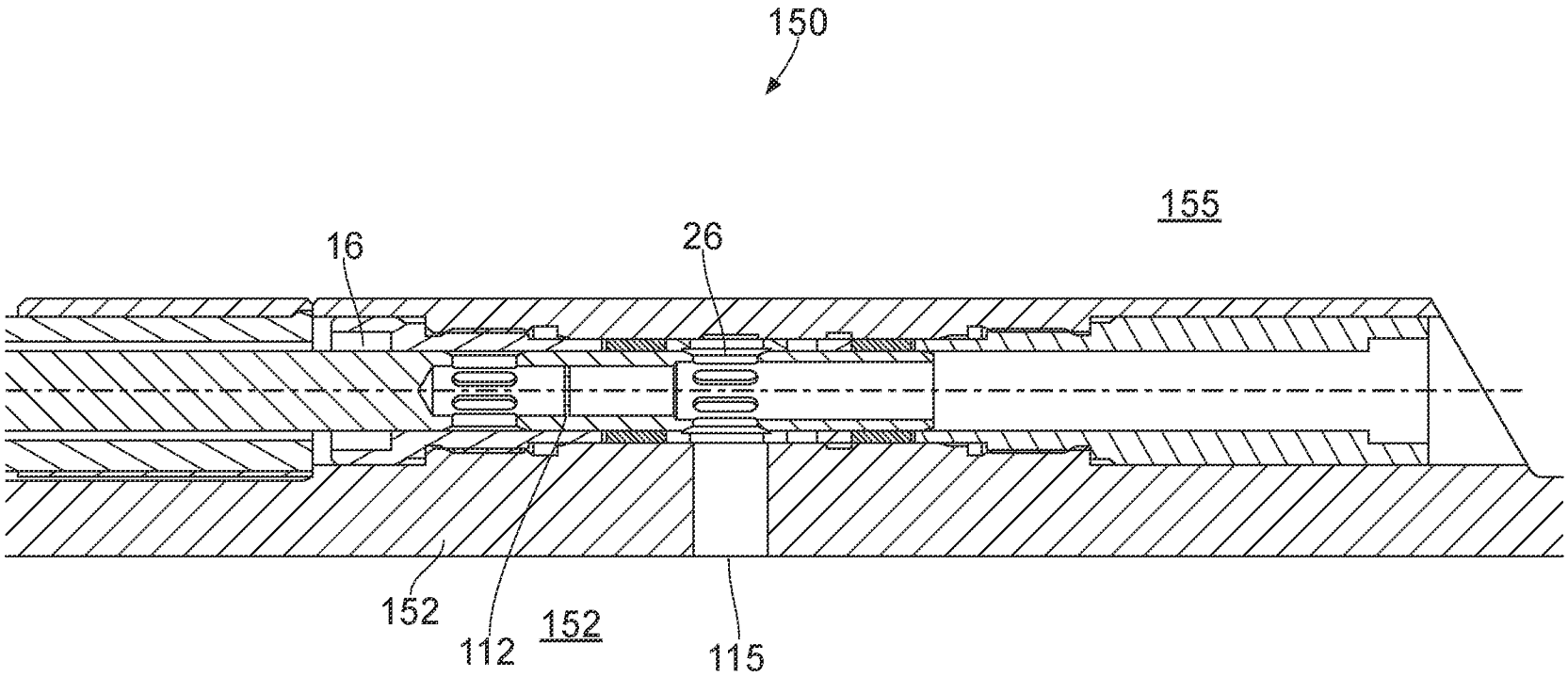
Figure 3:
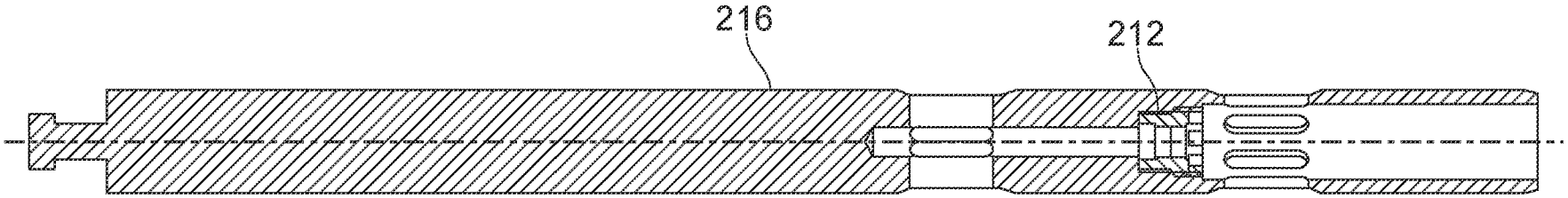
Figure 4A:
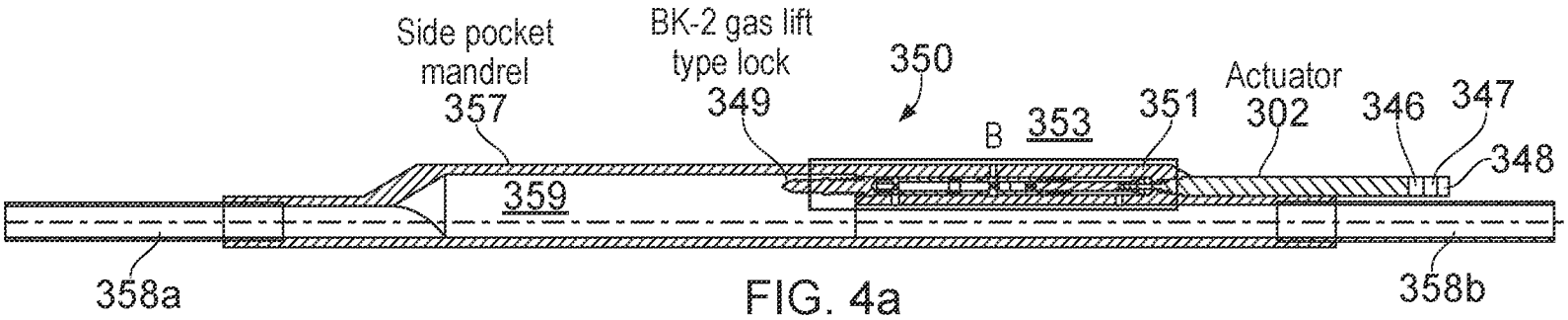
Figure 4B:
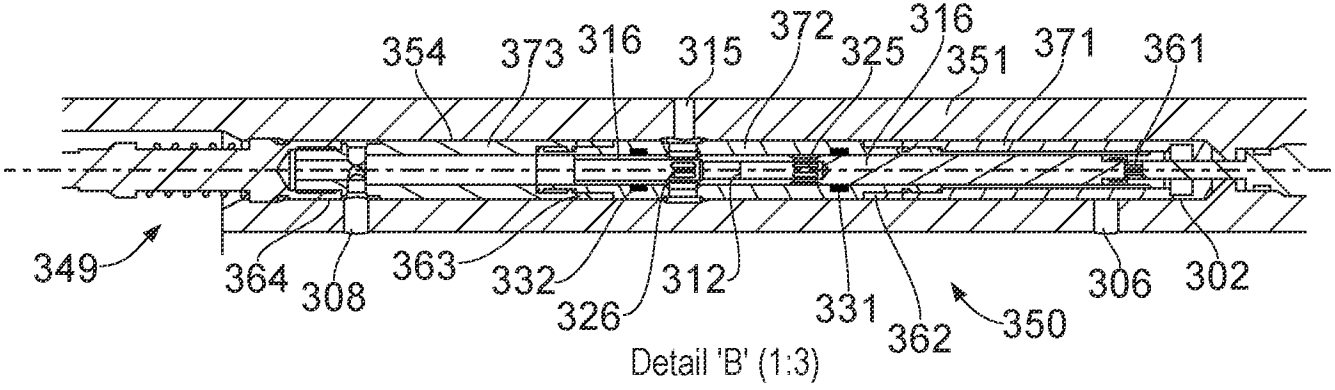

FIG. 1*c* is a cross-sectional view of the FIG. 1*a* rupture apparatus shown in a fully closed position;

FIG. 1*d* is a cross-sectional view of the FIG. 1*a* rupture apparatus shown in a fully open position;

FIG. 2*a* is a cross-sectional view of an alternative embodiment of a rupture apparatus with a sealing rod, shown in a rupturable position;

FIG. 2*b* is a cross-sectional view of the FIG. 2*a* rupture apparatus shown in a fully closed position;

FIG. 2*c* is a cross-sectional view of the FIG. 2*a* rupture apparatus shown in a fully open position;

FIG. 3 is a cross-sectional view of an alternative sealing rod comprising a discrete rupture disc;

FIG. 4*a* is a cross-sectional view of a further embodiment of the FIG. 2*a* rupture apparatus on an outer wall of a side pocket mandrel; and FIG. 4*b* is a cross-sectional view of the portion bounded by the rectangular box 'B' in FIG. 4*a*, showing the rupture apparatus in more detail.

FIG. 1*a* shows a rupture apparatus 50 on an outer face of a tubular member 52 which forms part of a casing string 53 in a wellbore annulus 55.

As shown in more detail in FIGS. 1*b*-1*d*, a housing bore 54 of the rupture apparatus 50 is defined in a valve housing 51. A seal carriage comprising three moveable seal carriers 41, 42, 43, each with respective seals 31, 32, 33 attached, is provided in the housing bore 54. The seal carriage can be moved to change the valve position between open, closed and rupturable valve positions to selectively allow or resist fluid communication between the bore of the tubular 52 and the annulus 55, via a main port 15 in the tubular 52. A pressure balancing port 6 is provided in the valve housing 51 to equalise pressure on either side of one or more of the moveable seal carriers 41, 42, 43 as described below.

FIGS. 1*a*-1*d* show the rupture apparatus 50 in its three fundamental positions: a rupturable position in FIGS. 1*a* and 1*b*, a fully closed position in FIG. 1*c* and a fully open position in FIG. 1*d*. The rupture apparatus 50 operates through axial movement of the seal carriers 41, 42, 43 in the housing bore 54.

The seal carriers 41, 42, 43 may be positioned (and repositioned) independently of the rupture-state of a rupture disc 12 in the first seal carrier 41, and so the rupture apparatus 50 may be fully closed, fully opened, or placed in the rupturable position indefinitely. The latter valve position allows a differential pressure on either side of the rupture disc 12 to rupture through the rupture disc 12 if it exceeds a threshold value. In this example, the pressure value that the rupture disc 12 ruptures at is 10% below the pressure rating of the tubular 52.

It is an advantage of such embodiments of the invention that the rupture apparatus 50 may be moved between positions regardless of the state of the rupture disc 12, and without rupturing the rupture disc 12.

In FIG. 1*b*, the rupture apparatus 50 of FIG. 1*a* is shown in more detail.

The seal carriers 41, 42, 43 of the rupture apparatus 50 are situated within the housing bore 54. The seal carriers 41, 42, 43 are connected to each other, with the first seal carrier 41 being connected to the second, and the second seal carrier 42 being connected to the third seal carrier 43 via a coupling 7. The housing bore 54 is in fluid communication with the annulus 55 outside the valve housing 51.

The first seal carrier 41 carries a first seal 31, and is tubular with the rupture disc 12 formed across its inside. The second seal carrier 42 carries a second seal 32, and has a plurality of seal carrier ports 29. The seal carrier ports 29 are configured to allow fluid communication from the port 15 in the tubular 52 to the rupture disc 12, via the second and then first seal carriers 42 & 41. The third seal carrier 43 and third seal 33 are connected to an axial-movement actuator via an actuator extension piece 2. The three seals 31, 32, 33 are configured to seal between the housing bore 54 and their respective seal carriers 41, 42, 43, such that further sealing elements (e.g. a sealing thread) are not required. The diameters of all three seals 31, 32, 33 are the same which helps to load-balance the seal carriers 41, 42, 43 across the port 15. In this example, the seals are V-seals.

The port 15 in the tubular 52 intersects the housing bore 54 and so allows fluid communication between the housing bore 54 and the tubular 52. The pressure balancing port 6 allows fluid communication between the housing bore 54 and the annulus 55.

The actuator extension piece 2 is configured to move the seal carriers 41, 42, 43 and their respective seals 31, 32, 33 along the housing bore 54 between the three fundamental positions of the rupture apparatus 50.

In FIG. 1*b*, the rupture apparatus 50 is shown in the rupturable position. In the rupturable valve position, the axial position of the seal carriers 41, 42, 43 with respect to the valve housing 51 are such that the first and second seals 31, 32 are positioned on either side of the port 15. When the rupture apparatus 50 is in the rupturable position, the first and second seals 31, 32 are active and seal against the housing bore 54, but the third seal 33 is unseated in a slightly larger-diameter portion of the housing bore 54.

In the rupturable valve position, the seal carrier ports 29 are positioned at the port 15. Thus, the seal carrier ports 29 are fluid-accessible via the port 15.

The coupling 7 between the second and third seal carriers 42, 43 has a reduced diameter in its central portion. In this valve position, the pressure balancing port 6 in the valve housing 51 is adjacent to the coupling 7. The pressure balancing port 6 and coupling 7 provide a fluid path between the annulus 55 and the housing bore 54, and so annulus pressure acts on the second seal 32, as well as the first seal 31 from the opposite end of the housing bore 54, thus balancing the load on the first and second seal carriers 41, 42 across the port 15 so that they do not move in the absence of other forces.

The rupture disc 12 is in fluid communication with the casing string 53 (via the seal carrier ports 29, the port 15, and the tubular 52), and the annulus 55 (via the first seal carrier 41 and the housing bore 54). This can result in a pressure differential acting on the rupture disc 12, despite the load-balanced condition of the seal carriers 41, 42, 43.

So long as the rupture disc 12 has not ruptured, the rupture apparatus 50 in the FIG. 1*a* position will be conditionally closed. If the pressure differential acting on the rupture disc 12 exceeds a threshold value, then the rupture disc 12 will rupture and allow fluid communication between the annulus 55 and the casing string 53 via the tubular 52. This may help to keep the annular pressure from becoming dangerously high.

If the rupture disc 12 has been ruptured, the rupture apparatus 50 when in the FIGS. 1*a* & 1*b* position will effectively be open thereafter. If it is desired to close the rupture apparatus 50 after the rupture disc 12 has ruptured, then the seal carriers 41, 42, 43 can be moved to the closed position.

Load-balancing the seal carriers 41, 42, 43 across the port 15 when the rupture apparatus 50 of such embodiments of the invention is in the rupturable valve position is advantageous, because it means that the actuator does not need to maintain a force on the seal carriers 41, 42, 43 (via actuator extension piece 2) to prevent the rupture apparatus 50 from moving from its position. Moreover, when it is desired to move the rupture apparatus 50 to a different valve position, there is less force required to be applied by the actuator extension piece 2.

A seal being unseated also aids in the reduction of force required to move the seal carriage, especially in high pressure applications. Having seal 33 unseated reduces the friction caused by static pressure on the seals, and reduces the force needed to move the rupture apparatus 50 into a different position.

The actuator extension piece 2 moves the seal carriers 41, 42, 43 axially in the housing bore 54 to move the rupture apparatus 50 from the rupturable (FIGS. 1*a* and 1*b*) position to another position, in this case the fully closed FIG. 1*c* position. A wireless control signal in the form of an acoustic or electromagnetic (EM) signal is sent to a receiver (not shown) coupled to the actuator from the surface or another communications source (not shown) to initiate the movement of the actuator extension piece 2.

In FIG. 1*c*, the rupture apparatus 50 is shown in the fully closed position. In the fully closed position, the axial position of the seal carriers 41, 42, 43 with respect to the valve housing 51 is such that the second and third seals 32, 33 are positioned on either side of the port 15. The second and third seals 32, 33 are active and effectively seal off the port 15, whilst the first seal 31 is unseated.

As with the rupturable valve position shown in FIGS. 1*a* & 1*b*, the seal carriers 41, 42, 43 are also load-balanced across the port 15 in the fully closed position. The second seal carrier 42 is exposed to the annulus pressure through the housing bore 54. The diameter of the actuator extension piece 2 being less than the housing bore 54 results in the third seal carrier 43 being exposed to the annulus pressure through the pressure balancing port 6. Both second and third seal carriers 42, 43 are indirectly exposed to the casing string pressure via the port 15. In a manner similar to that described in relation to FIG. 1*b*, there are balanced forces acting on the second and third seals 32, 33.

The annulus 55 is still in fluid communication with one side of the rupture disc 12, through the first seal carrier 41. However, the rupture disc 12 is no longer in fluid communication with the casing string 53. Because the first seal 31 is now unseated in a larger-diameter section of the housing bore 54, the other side of the rupture disc 12 is also in fluid communication with the annulus 55, via seal carrier ports 29. Therefore, when the rupture apparatus 50 is in the fully closed FIG. 1*c* position, the rupture disc 12 is pressure balanced and will not rupture, if it is intact.

This is an advantage of such embodiments of the invention when it is desired to prevent inadvertent rupture of the rupture disc 12.

In a modified embodiment, the first seal 31 can remain seated. To provide for pressure balance across the rupture disc 12, a further pressure balancing port (not shown) can be provided in the housing 51 between the first seal 31 and the second seal 32. For certain embodiments, maintaining the seal in an active position can improve its longevity, as opposed to switching between active and inactive states.

The actuator extension piece 2 moves the seal carriers 41, 42, 43 axially in the housing bore 54 to move the rupture apparatus 50 from the fully closed FIG. 1*c* position to another position, in this case the fully open FIG. 1*d* position. An EM or acoustic wireless control signal is sent to the receiver (not shown) coupled to the actuator from the surface or another communications source (not shown) to initiate movement of the actuator extension piece 2.

FIG. 1*d* shows the rupture apparatus 50 in the fully open position. In the fully open position, the axial position of the seal carriers 41, 42, 43 with respect to the valve housing 51 is such that the port 15 is no longer sealed off by any two seals but is in direct fluid communication with the housing bore 54 and annulus 55, bypassing the seal carriers 41, 42, 43 altogether.

The seal carriers 41, 42, 43 remain stationary whilst the rupture apparatus 50 is in the fully open position because there are no unbalanced forces acting on them.

In use, if the rupture disc 12 has not been ruptured, both sides of the rupture disc 12 are in fluid communication with the annulus 55, one via the pressure balancing port 6 and the other via the housing bore 54 and the first seal carrier 41, so there is no pressure differential acting here, and the rupture disc is not at risk of inadvertently rupturing.

Thus an advantage of preferred embodiments of the invention, such as the above embodiment, is that casing annuli can be more conveniently controlled using the rupture apparatus. Accordingly if these annuli increase in pressure, for example caused by fluids leaking into the annulus, or for example warm fluids being produced in the tubular, such embodiments can be used to bleed the pressure therefrom. As well as safety benefits, in certain situations, this can allow higher production rates to be used, especially for higher temperature wells, where the heat sustained at a higher flow rate could otherwise over-pressure an annulus when being produced.

If the rupture disk is ruptured, the casing can be maintained in the well with rupture apparatus in a closed position whereas this would have previously caused the well to be abandoned or used in a very restricted manner.

Advantageously, regardless of the valve position, the seals 31, 32, 33 are potentially less exposed to the potentially erosive fluid flow. The rupture apparatus 50 of such embodiments of the invention is designed such that the sealing surfaces are kept well away from the fluid flow-path.

FIGS. 2*a*-2*c* show a further embodiment which includes like parts with the FIGS. 1*a*-1*d* embodiment and these are not described again in detail. The reference numerals of the like parts share the same latter two digits in both embodiments, but differ in that they are prefixed with a '1' in this second embodiment.

In the FIGS. 2*a*-2*c* embodiment of a rupture apparatus 150, an axially-moveable sealing rod carriage 16. The sealing rod carriage 16 (hereinafter "sealing rod 16") carries a rupture disk 112, but does not carry seals. Instead, stationary first and second seals 131, 132 are provided.

The sealing rod 16 is partially tubular. It contains sealing rod ports 25 as well as the rupture disc 112 which is formed across the inside of the sealing rod 16. It also contains secondary sealing rod ports 26 which are disposed further along the sealing rod 16, on the other side of the rupture disc 112.

The rupture apparatus 150 has the same three fundamental positions as in the FIGS. 1*a*-1*d* embodiment (rupturable, fully closed and fully open) and is likewise load-balanced across the port 115 in these valve positions.

First and second seals 131, 132 are mounted within the housing bore 154 of the valve housing 151. The first and second seals 131, 132 are held in place in the housing bore 154 by a central cylindrical spacer 19, and on their other sides by a respective retaining member 17, 24. The cylindrical spacer 19 has a hole therein to allow fluid to pass between the spacer and the port 115. The seals 131, 132 are configured to seal between the housing bore 154 and the sealing rod 16.

The first and second seals 131, 132 have the same diameter as each other. As with the previous embodiment, this helps when load-balancing the sealing rod 16 across the port 115.

In FIG. 2*a*, the sealing rod 16 is positioned such that the sealing rod ports 25 align with the port 115. The rupture apparatus 150 is shown in the rupturable valve position.

The sealing rod ports 25 provide fluid-access from the tubular 152 through the port 115 to the inside of the sealing rod 16, and to the rupture disc 112 formed across the inside of the sealing rod 16.

In use, the rupture disc 112 experiences a differential pressure because annulus 155 pressure is acting on one side of the disc, and the casing string pressure (via the tubular 152) is acting on the other.

As with the previous embodiment, when the rupture apparatus 150 is in the rupturable valve position the differential pressure does not impart any unbalanced load to the sealing rod 16, across the port 115.

FIG. 2*b* shows the rupture apparatus 150 of the sealing rod embodiment in the fully closed position. The sealing rod 16 has moved axially along the housing bore 154 such that none of the sealing rod ports 25, 26 align with the port 115. The seals 131, 132 obstruct fluid flow from the tubular 152 to the ports of the sealing rod 25, 26.

Fluid is completely restricted from flowing between the tubular 152 and the annulus 155.

As with the previous embodiment, when the rupture apparatus 150 is in the fully closed position the differential pressure between the casing string (via the tubular 152) and the annulus 155 does not impart any unbalanced load to the sealing rod 16 across the port 115.

Annulus 155 pressure acts on both sides of the rupture disc 112, and so does not rupture the disc if it is still intact.

FIG. 2*c* shows the rupture apparatus 150 of the sealing rod embodiment in the fully open position, in which the sealing rod 16 is positioned such that the secondary sealing rod ports 26 align with the port 115.

Fluid can flow freely between the tubular 152 and the annulus 155.

Annulus 155 pressure acts on both sides of the rupture disc 112, and so does not rupture the disc if it is still intact.

FIG. 3 shows a further embodiment of the sealing rod 16. This embodiment includes like parts with the FIGS. 2*a*-2*c* embodiment and these are not described again in detail. The reference numerals of the like parts share the same latter two digits in both embodiments, but differ in that they are prefixed with a '2' in this further embodiment.

The FIG. 3 sealing rod carriage 216 contains a discrete rupture disc component 212, which may be used in place of the rupture disc 112 used in the FIGS. 2*a*-2*c* embodiment.

This alternative version of the sealing rod 216 may be used in place of the sealing rod 16 of said FIGS. 2*a*-2*c* embodiment.

An advantage of such embodiments of the invention is that the rupture disc component 212 may be more readily replaced because it is a separate part to the rest of the sealing rod using conventional means, such as wireline or coiled tubing.

FIGS. 4*a* and 4*b* show a further embodiment of the present invention which includes like parts with the FIGS. 2*a*-2*c* embodiment and these are not described again in detail. The reference numerals of the like parts share the same latter two digits in both embodiments, but differ in that they are prefixed with a '3' in this later embodiment.

The FIGS. 4*a* and 4*b* embodiment comprises a rupture apparatus 350 on an outer face of a side pocket mandrel 357 and side pocket mandrel cavity 359 which forms part of a production tubing string 358*a*, 358*b* in a surrounding portion of the well 353.

As best seen in FIG. 4*a*, the rupture housing 351 forms part of the side pocket of the side pocket mandrel 357 and side pocket mandrel cavity 359, which is connected to the production tubing 358*a*, 358*b* at either end. The side pocket mandrel cavity 359 is in fluid communication with the inside of the production tubing 358*a*, 358*b*.

A conventional gas lift lock 349, such as a BK-2 type lock, is located within the side pocket of the mandrel 357 adjacent one end of the rupture apparatus 350. At the other end of the rupture apparatus 350 is an actuator 302. The actuator 302 is connected to a battery 346, a wireless control module 347, and a pressure sensor 348 to monitor the pressure in the surrounding portion of the well 353. The actuator 302 can thus be powered and controlled from a downhole location, to actuate the rupture apparatus 350 according to the monitored pressure conditions. A pressure sensor may also or alternatively be run into the well on a toolstring, to monitor the pressure within the tubing 358*a*, 358*b* and side pocket mandrel cavity 359.

FIG. 4*b* shows in more detail the features bounded by the rectangular box 'B' in FIG. 4*a*. The rupture apparatus 350 comprises an axially-moveable sealing rod carriage 316 with a rupture disc 312 and first and second sets of sealing rod ports 325, 326 as described in relation to the FIGS. 2*a*-2*c* embodiment.

A main port 315 intersects the valve housing 351 and is in fluid communication with the surrounding portion of the well 353. A pressure balancing port 306 intersects the inner wall of the side pocket mandrel 357 and side pocket mandrel cavity 359. A flow port 308 is also provided, which also intersects the inner wall of the side pocket mandrel 357 and the side pocket mandrel cavity 359.

In the present embodiment, there is a stationary sleeve comprised of first, second and third portions 371, 372, 373. The sleeve 371, 372, 373 comprises a set of inner seals and a set of outer seals. The first and second inner seals 331, 332 are essentially the same as described in relation to the FIGS.

2*a*-2*c* embodiment, but here they are configured to seal between the sealing rod 316 and the inside of the second portion of the sleeve 372. The first and second outer seals 362, 363 have the same diameter as each other and are configured to seal between the housing bore 354 and the stationary sleeve 371, 372, 373.

The stationary sleeve 371, 372, 373, the sealing rod 316 and the gas lift lock 349 are removeable from the rupture housing 351 as a single unit. These components can be removed from the side pocket mandrel cavity 359 in-situ downhole, and replaced with a conventional passive valve, for example.

A collect mechanism 361 releasably locks the actuator 302 to the sealing rod 316. Whilst the actuator 302 engages with the sealing rod 316, the flow port 308 remains aligned with a sleeve port 364 near the end of the third portion of the sleeve 373, which keeps part of the sealing rod 316 in fluid communication with the side pocket mandrel cavity 359. By virtue of the pressure balancing port 306, the opposing side of the sealing rod 316 is also kept in fluid communication with the side pocket mandrel cavity 359. This helps to ensure the pressure and forces are balanced across the rod 316 and the inner seals 331, 332 such that force from the actuator need not always be exerted on them to maintain the sealing rod's 316 position. The pressure balancing port 306 also helps to ensure the removeable parts can be removed from the housing bore 354 with greater ease.

The rupture apparatus 350 has the same three fundamental positions as in the FIGS. 2*a*-2*c* embodiment (rupturable, fully closed and fully open) and is likewise load-balanced across the main port 315 in these valve positions.

In FIG. 4*b*, the rupture apparatus 350 is shown in the open valve position, wherein the sealing rod 316 is positioned such that the sealing rod ports 326 align with the main port 315. In this position, there is unconditional fluid communication from the mandrel cavity 359 to the surrounding portion of the well 353 via the flow port 308 and sealing rod ports 326.

In the rupturable valve position, the sealing rod 316 is moved axially in the stationary sleeve 371, 372, 373 such that the second set of sealing rod ports 325 are in fluid communication with the main port 315. In use, when it has not been ruptured, the rupture disc 312 can experience a differential pressure because the surrounding well pressure 353 is acting on one side of the disc 312, and the mandrel cavity 359 pressure is acting on the other.

In the closed valve position, the sealing rod 316 is moved axially further in the stationary sleeve 371, 372, 373 such that both sets of sealing rod ports 325, 326 are beyond the second inner seal 332. The closed section of the rod 316 is then positioned between the seals 332 and blocks communication to the port 315. In this position, there is no fluid communication between the mandrel cavity 359 and the surrounding well 353. Both sides of the rupture disc 312 are exposed to the pressure inside the mandrel bore 359 via the flow port 308 and the sealing rod ports 325, 326 on one side and pressure balancing port 306 on the opposing side.

The first seal carrier, sealing rod or discrete rupture disc component may be of a welded construction. This can help support the seal and/or the rupture disc. This construction may be advantageous for constructing a sufficiently robust seal and/or rupture disc.

The seals may be of a metallic construction to provide metal-to-metal seals between their respective seal carriers or sealing rod, and the housing bore.

The diameters of the seals in the above embodiments may optionally be different from one another. The actuator extension piece may optionally be used to force or assist the seal carriers or sealing rod to stay in one position, for example, in the case of an unbalanced load condition across the seal carriers or sealing rod.

In certain embodiments, the rupture disc may only be capable of rupturing due to a pressure above a certain threshold acting on one of its sides, and may resist rupture as a result of pressure acting on its other side, i.e. it may be a one-way rupture disc.

In alternative embodiments, the rupture apparatus has two valve positions only: a rupturable position and one of an open position and a closed position. Sensors may be provided in various positions on the apparatus in certain embodiments, such within the housing bore, for example on either side of the rupture disc. They may be used to sense the differential pressure across the rupture disc.

An advantage of certain embodiments is that a rupture mechanism can be isolated and/or bypassed using a single apparatus and/or actuator, thus also saving costs of providing more than one apparatus and/or actuator. This can also help the apparatus to fit within confined spaces downhole.

An advantage of certain embodiments is that in the event of an increase in pressure within the bore in the tubular, or within the annulus, the pressure can be reduced by changing the valve position to the open position. The valve can then be reset, that is, it can be moved to the closed valve position (which may be the sealing position) or the rupturable valve position (which may be the safety position). In contrast, conventional rupture discs typically need to rupture to provide pressure relief, and cannot be sealed again. If the rupture disc and associated components are safety-critical, they may need to be recovered to surface and replaced, which incurs significant costs and downtime.

Embodiments so the invention are particularly useful in a subsea well where the outer annuli are not controllable and are sealed.

The invention claimed is:

1. A rupture apparatus disposed on a tubular member,
the rupture apparatus comprising:
a housing defining a housing bore with a bore inlet and a bore outlet; and
a carriage carrying a rupturable component,
wherein the carriage is moveable in the housing bore between a rupturable position and at least one of an open and closed position, and, wherein the carriage comprises a further tubular member having at least one carriage port between a bore of the further tubular member and an outside thereof.

2. A rupture apparatus comprising:
a housing defining a housing bore with a bore inlet and a bore outlet;
a carriage carrying a rupturable component,
wherein the carriage is moveable in the housing bore between a rupturable position and at least one of an open and closed position; and
a pressure balancing port defined in a wall of the housing allowing fluid communication between at least a portion of the housing bore and an outside of the housing, wherein, in the open position, at least a portion of a first face of the rupturable component is exposed to a first pressure and at least a portion of an opposing face of the rupturable component is exposed to a second pressure, one of said faces being exposed to at least one of said first and second pressure via the pressure balancing port.

3. The rupture apparatus of claim 2, further comprising a wireless communication module configured to receive at least one of coded pressure pulse, acoustic and/or electromagnetic signals, to direct movement of the carriage.

4. The rupture apparatus of claim 2, further comprising at least one seal between an outer surface of the carriage and an inner surface of the housing bore.

5. The rupture apparatus of claim 4, wherein the at least one seal can alternate between actively sealing with the inner surface of the housing bore and being inactive.

6. The rupture apparatus of claim 4, further comprising a plurality of seals, wherein at least one of the plurality of seals is configured to be inactive whilst at least another two of the plurality of seals actively seal between the inner surface of the housing bore and the carriage.

7. The rupture apparatus of claim 4, wherein the at least one seal is non-elastomeric.

8. The rupture apparatus of claim 2, wherein the carriage is moveable between the rupturable position and the closed position.

9. The rupture apparatus of claim 2, wherein the carriage is moveable between the rupturable position and the open position.

10. The rupture apparatus of claim 2, wherein the carriage is configured to move in the housing bore in an axial direction, parallel with a main longitudinal axis of the housing bore.

11. The rupture apparatus as claimed in claim 2, wherein the rupture apparatus is disposed on a tubular member.

12. The rupture apparatus of claim 11, wherein a primary path for fluid flow through the rupture apparatus is defined in the housing bore, such that the primary fluid flow path is in part defined by the tubular member.

13. A rupture apparatus disposed on a tubular member, the rupture apparatus comprising:

a housing defining a housing bore with a bore inlet and a bore outlet; and a carriage carrying a rupturable component, wherein the carriage is moveable in the housing bore between a rupturable position and at least one of an open and closed position, and, wherein in the rupturable position, at least a portion of one face of the rupturable component is in fluid communication with a port of the tubular member, and at least a portion of a second face of the rupturable component is in fluid communication with an outside of the tubular member.

14. The rupture apparatus of claim 2, wherein a tubular member includes the rupture apparatus and defines an inner bore.

15. The tubular member apparatus of claim 14, wherein the housing bore is in fluid communication with at least a portion of an outside of the tubular member and the inner bore of the tubular member.

16. The tubular member apparatus of claim 14, wherein a main axis of the housing bore is off-centre compared to a main axis of the tubular member.

17. The tubular member apparatus of claim 14, wherein the housing bore is within a wall of the tubular member.

18. The tubular member apparatus of claim 14, wherein the rupture apparatus is provided in a side pocket mandrel.

19. The tubular member apparatus of claim 14, wherein the tubular member forms part of a casing string.

20. The tubular member apparatus of claim 19 wherein the casing string comprises an inner diameter of between 5 inches (127 mm) and 20 inches (510 mm).

21. A well comprising the rupture apparatus of claim 2.

22. A well as claimed in claim 21, wherein the well is a subsea well.

23. A well as claimed in claim 21, wherein the rupture apparatus is coupled to a wireless data communication module configured to transmit signals in at least one of the following forms: electromagnetic, acoustic, coded pressure pulses and inductively coupled tubulars.

24. A well as claimed in claim 21, wherein the rupture apparatus is positioned one of at least 500 m, at least 1000 m or at least 1500 m deep in the well.

25. A system comprising the rupture apparatus of claim 2, further comprising an axial-movement actuator configured to cause axial movement of the carriage in the housing bore.

26. The system as claimed in claim 25, wherein the actuator is hydraulically actuated.

27. The system as claimed in claim 25, wherein the actuator comprises a single actuator which provides for movement of the carriage between the rupturable position, the open position, and the closed position.

28. The system as claimed in claim 25, wherein the actuator is powered by an in-well power source.

29. A well comprising the tubular member apparatus as claimed in claim 14.

30. A well of claim 29, wherein the tubular member apparatus comprises a tubular, in part, defining at least one of a B-annulus and outer annulus.

31. A system comprising the tubular member apparatus as claimed in claim 14, and further comprising an axial-movement actuator configured to cause axial movement of the carriage in the housing bore.

* * * * *